US010930994B2

(12) United States Patent
Ligander et al.

(10) Patent No.: US 10,930,994 B2
(45) Date of Patent: Feb. 23, 2021

(54) WAVEGUIDE TRANSITION COMPRISING A FEED PROBE COUPLED TO A WAVEGUIDE SECTION THROUGH A WAVEGUIDE RESONATOR PART

(71) Applicant: Telefonaktiebolaget LM Ericsson (publ), Stockholm (SE)

(72) Inventors: Per Ligander, Gothenburg (SE); Ola Tageman, Gothenburg (SE)

(73) Assignee: Telefonaktiebolaget LM Ericsson (Publ), Stockholm (SE)

( * ) Notice: Subject to any disclaimer, the term of this patent is extended or adjusted under 35 U.S.C. 154(b) by 0 days.

(21) Appl. No.: 16/335,472

(22) PCT Filed: Oct. 6, 2016

(86) PCT No.: PCT/EP2016/073907
§ 371 (c)(1),
(2) Date: Mar. 21, 2019

(87) PCT Pub. No.: WO2018/065059
PCT Pub. Date: Apr. 12, 2018

(65) Prior Publication Data

US 2019/0229391 A1 Jul. 25, 2019

(51) Int. Cl.
*H01P 5/107* (2006.01)
*H01P 3/08* (2006.01)
(Continued)

(52) U.S. Cl.
CPC ..... *H01P 5/107* (2013.01); *H01P 3/08* (2013.01); *H01P 3/12* (2013.01); *H01P 5/08* (2013.01)

(58) Field of Classification Search
CPC ..... H01P 5/107
(Continued)

(56) References Cited

U.S. PATENT DOCUMENTS 5,821,836 A 10/1998 Katehi et al.
6,958,662 B1 * 10/2005 Salmela et al. ..... H01P 5/107 333/247
(Continued)

FOREIGN PATENT DOCUMENTS

EP 1928052 A1 4/2008
EP 1923950 A1 5/2008
EP 2333828 A1 6/2011

OTHER PUBLICATIONS

Alléaume, PF. et al., "Millimeter-wave SMT Low Cost Plastic Packages for Automotive Radar at 77GHz and High Data Rate E-band Radios", 2009 IEEE MTT-S International Microwave Symposium Digest, Jun. 7-12, 2009, pp. 789-792, Boston, MA, US.
(Continued)

*Primary Examiner* — Benny T Lee
(74) *Attorney, Agent, or Firm* — Patent Portfolio Builders, PLLC

(57) ABSTRACT

The present disclosure relates to a waveguide transition arrangement (1) comprising a first ground plane (6) with a first aperture (7), a feed probe (4) that crosses the first aperture (7), a second ground plane (8) with a second aperture (9), and a waveguide resonator part (10) that has an opening (11) that faces the second aperture (9). The first ground plane (6) faces the second ground plane (8) and is positioned between the feed probe (4) and the second ground plane (8), and the second ground plane (8) faces the waveguide resonator part (10). A wall structure (12) is at least partly arranged between the first ground plane (6) and the second ground plane (8) such that a first cavity (13) is formed in an enclosed volume between them. The first aperture (7) and the second aperture (9) are electromagnetically connected to the first cavity (13), and where the second aperture (9) to a second cavity (14) in the waveguide
(Continued)

resonator part (10) which is electromagnetically connected to a waveguide section (15) via a third aperture (16).

11 Claims, 5 Drawing Sheets

(51) Int. Cl.
*H01P 3/12* (2006.01)
*H01P 5/08* (2006.01)

(58) Field of Classification Search
USPC ..... 333/26
See application file for complete search history.

(56) References Cited

U.S. PATENT DOCUMENTS

| | | | | |
|---|---|---|---|---|
| 7,405,477 | B1 | 7/2008 | Tao et al. | |
| 2004/0183621 | A1* | 9/2004 | Lo Hine Tong et al. | H01P 1/209 333/26 |
| 2007/0262828 | A1* | 11/2007 | Fujita | H01P 5/107 333/26 |
| 2014/0176253 | A1* | 6/2014 | Niman et al. | H01P 5/107 333/26 |
| 2017/0301975 | A1* | 10/2017 | Flatters et al. | H01B 1/124 |

OTHER PUBLICATIONS

Papapolymerou, J. et al., "A Micromachined High-Q X-Band Resonator", IEEE Microwave and Guided Wave Letters, Jun. 1997, pp. 168-170, vol. 7, No. 6.

* cited by examiner

WAVEGUIDE TRANSITION COMPRISING A FEED PROBE COUPLED TO A WAVEGUIDE SECTION THROUGH A WAVEGUIDE RESONATOR PART

TECHNICAL FIELD

The present invention relates to a waveguide transition arrangement comprising a first ground plane with a first aperture, a feed probe that crosses the first aperture, a second ground plane with a second aperture, and a waveguide resonator part that has an opening that faces the second aperture.

BACKGROUND

In many fields of communication, a suitable transition from a microstrip conductor to a waveguide is desired. The most common type of such a transition is based on a probe with a metal back short on top of the probe. The probe is then located perpendicular to a rectangular waveguide, and a metal housing encloses the probe such that a metal back short is obtained by means of a housing wall that runs parallel to the probe at a distance of a quarter wavelength from the probe. The wavelength normally corresponds to the center frequency of the frequency band used.

Such a transition arrangement is for example described in EP 1367668 and U.S. Pat. No. 7,276,988.

However, the higher frequencies that are used, the more difficult it becomes to manufacture such a transition arrangement due to tight tolerances.

There is thus a desire to provide a transition from a microstrip conductor to a waveguide that is less sensible to manufacture and assembly tolerances than prior such transition arrangements

SUMMARY OF THE INVENTION

It is an object of the present invention to provide a transition from a micro strip conductor to a waveguide that is less sensible to manufacture and assembly tolerances than prior such transition arrangements.

This object is obtained by means of waveguide transition arrangement comprising a first ground plane with a first aperture, a feed probe that crosses the first aperture, a second ground plane with a second aperture, and a waveguide resonator part that has an opening that faces the second aperture. The first ground plane faces the second ground plane and is positioned between the feed probe and the second ground plane, and the second ground plane faces the waveguide resonator part. A wall structure at is least partly arranged between the first ground plane and the second ground plane such that a first cavity is formed in an enclosed volume between them. The first aperture and the second aperture are electromagnetically connected to the first cavity, and the second aperture is electromagnetically connected to a second cavity comprised in the waveguide resonator part. The waveguide resonator part is in turn electromagnetically connected to a waveguide section via a third aperture comprised in the waveguide resonator part, such that a transition for microwave signals from the feed probe to the waveguide section is obtained.

According to an example, the waveguide transition arrangement comprises a first dielectric layer having a first layer first side and a first layer second side, where the first ground plane is on the first layer second side with the first aperture at least partly being positioned.

According to another example, the waveguide transition arrangement comprises a second dielectric layer having a second layer first side and a second layer second side. The second ground plane with the second aperture is positioned on at least one of the second layer first side and a second layer second side.

According to another example, a ball grid array (BGA) that at least partly forms the wall structure is attached to the first layer second side.

According to another example, the feed probe is constituted by a strip conductor that is positioned on the first layer first side.

According to another example, the waveguide resonator part and the waveguide section are at least partly integrally formed; constituting a waveguide arrangement.

A number of advantages are obtained by means of the present invention. Mainly, a transition from a microstrip conductor to a waveguide that is relatively robust regarding manufacture and assembly tolerances is obtained. Furthermore, there is thus no need to bend the electromagnetic wave, and undesired radiation from the feed probe is practically negligible such that a feed probe cover normally is unnecessary.

BRIEF DESCRIPTION OF THE DRAWINGS

The present invention will now be described more in detail with reference to the appended drawings, where.

DETAILED DESCRIPTION OF THE INVENTION

Figure 1:
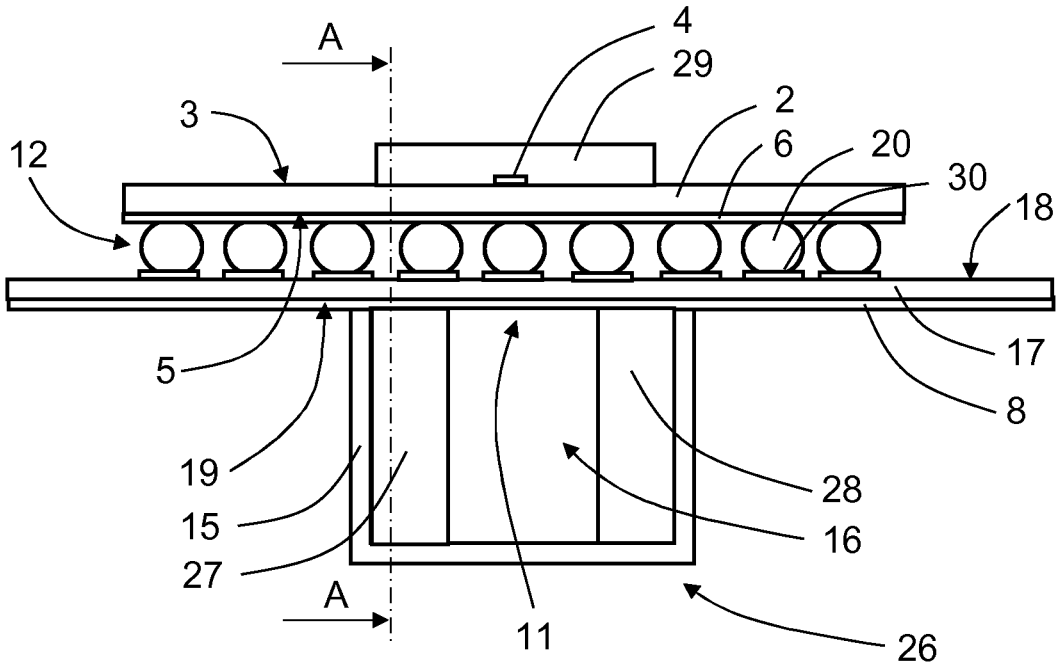
FIG. 1 shows a schematical front view of a waveguide transition arrangement.
Figure 2:
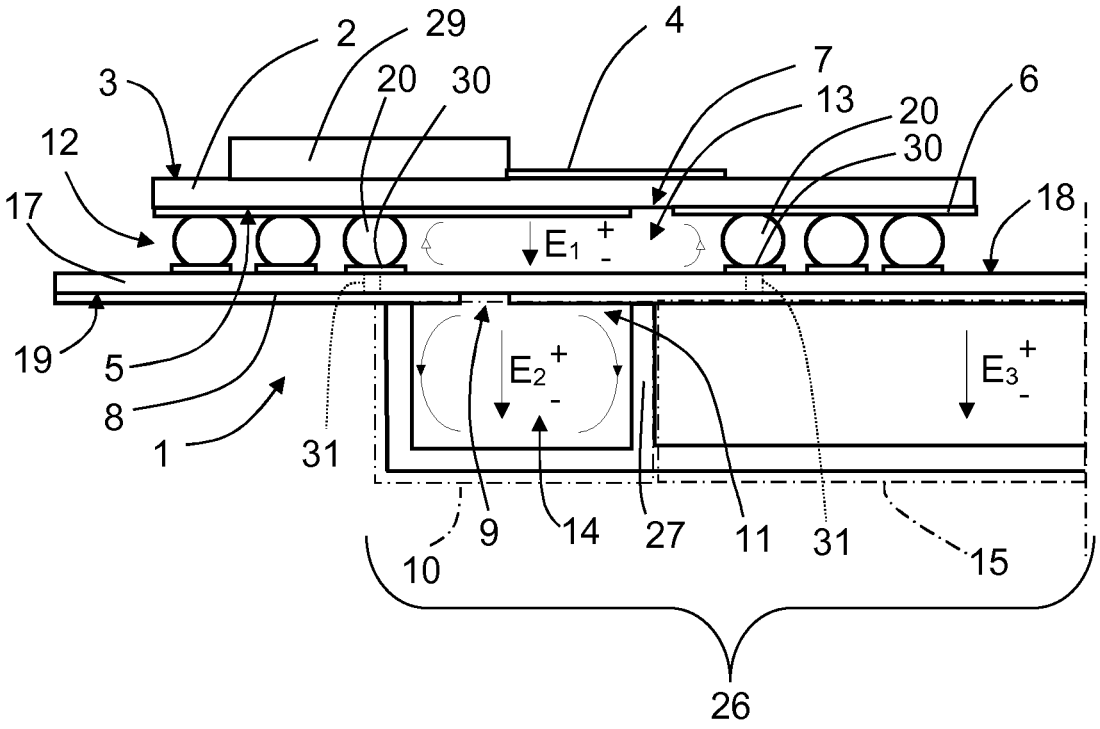
FIG. 2 shows a schematical cut-open side view of the a waveguide transition arrangement along a line A-A in FIG. 1.
Figure 3:
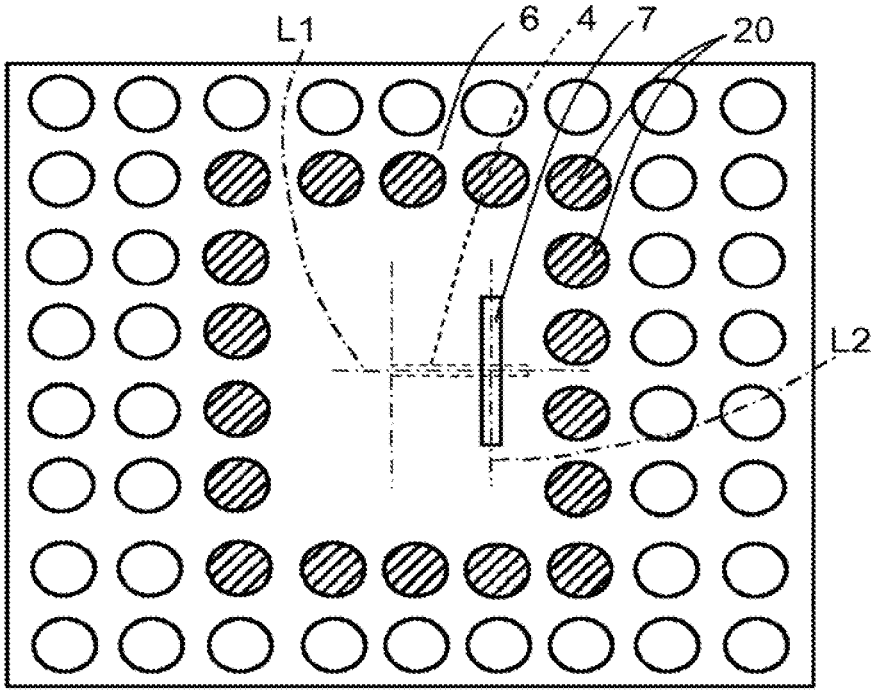
FIG. 3 shows a schematical bottom view of a first dielectric layer.
Figure 4:
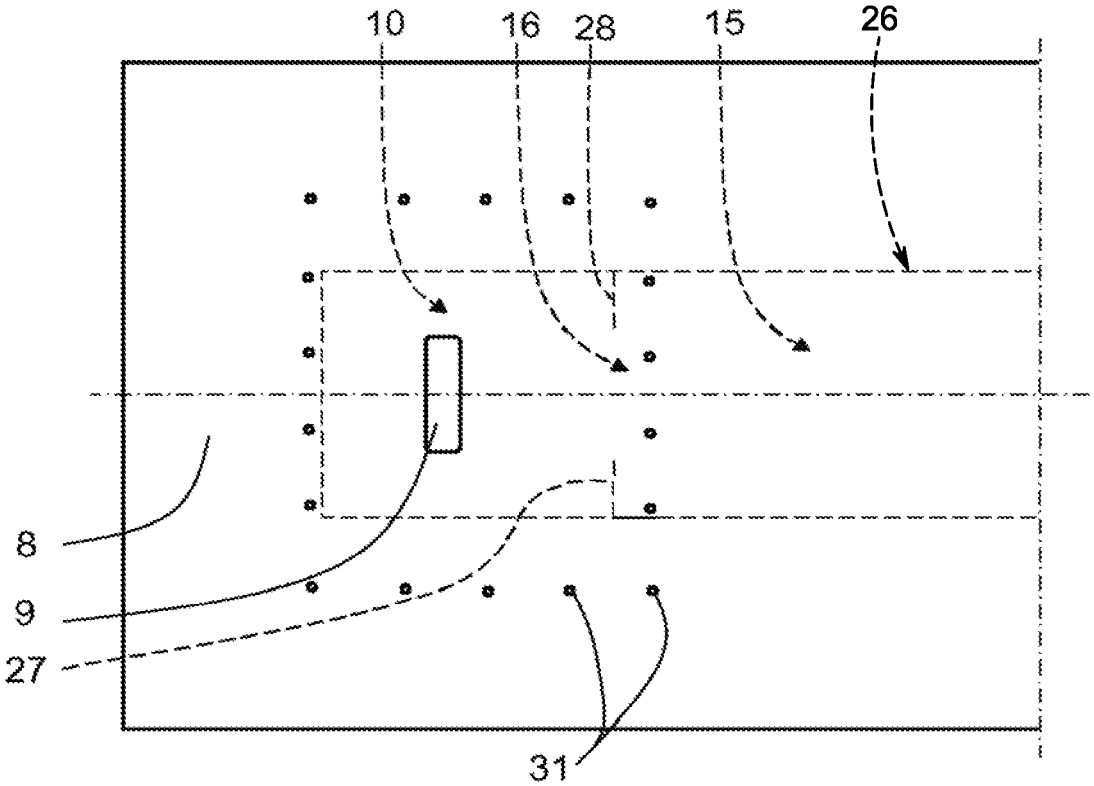
FIG. 4 shows a schematical bottom view of a second dielectric layer.

In the following, reference is made to FIG. 1, FIG. 2, FIG. 3 and FIG. 4. FIG. 1 shows a schematical front view of a waveguide transition arrangement, FIG. 2 shows a schematical cut-open side view of the a waveguide transition arrangement along a line A-A in FIG. 1, FIG. 3 shows a schematical bottom view of a first dielectric layer and FIG. 4 shows a schematical bottom top of a second dielectric layer.

There is a waveguide transition arrangement 1 (FIG. 2) comprising a first dielectric layer 2 (FIGS. 1 and 2) having a first layer first side 3 (FIGS. 1 and 2) on which a strip conductor 4 (FIGS. 1-3) is positioned and a first layer second side 5 (FIGS. 1 and 2) on which a first ground plane 6 (FIGS. 1-3) with a first aperture 7 (FIGS. 2 and 3) is positioned. The strip conductor 4 has a first longitudinal extension L1 (FIG. 3) and the first aperture has a second longitudinal extension L2 (FIG. 3), and the strip conductor 4 crosses the first aperture 7 such that the longitudinal extensions L1, L2 run mutually perpendicular to each other. The strip conductor 4 is in this example extending from a chip part 29 (FIGS. 1 and 2) that is mounted to the first layer first side 3, and is constituted by a microstrip conductor, comprised in a microstrip arrangement.

The waveguide transition arrangement 1 comprises a second dielectric layer 17 (FIGS. 1 and 2) having a second layer first side 18 (FIGS. 1 and 2) and a second layer second side 19 (FIGS. 1 and 2), on which a second ground plane 8 (FIGS. 1, 2, and 4) with a second aperture 9 (FIGS. 2 and 4) is positioned. The waveguide transition arrangement 1 further comprises a waveguide resonator part 10 (FIGS. 2 and 4) that has an opening 11 (FIGS. 1 and 2) that faces the second aperture 9, where the first ground plane 6 faces the second ground plane 8 and is positioned between the strip conductor 4 and second ground plane 8, where furthermore the second ground plane 8 faces the waveguide resonator part 10.

According to the present disclosure, the first dielectric layer 2 is attached and connected to the second dielectric layer 17 by means of a ball grid array 20 (BGA in FIGS. 1-3) (only one ball or two balls indicated in the Figures for reasons of clarity), such that a wall structure 12 (FIGS. 1 and 2) formed by the BGA 20 is arranged between the first ground plane 6 and the second ground plane 8, such that a first cavity 13 (FIG. 2) is formed in an enclosed volume between them. In order to ensure the functionality of the first cavity 13, the BGA 20 is soldered to pads 30 (FIGS. 1 and 2) on the second layer first side 18, where at least an inner wall of BGA balls as marked with section lines in FIG. 3 are grounded. This is accomplished by means of vias 31 (FIGS. 2 and 4) that connect the pads 30 to the second ground plane 8. Those pads that are not grounded are used for power and signal transfer to and from circuits on the first dielectric layer 2 such as the chip part 29. According to some aspects, the BGA is its entirety grounded, and necessary power and signal transfer to and from circuits on the first dielectric layer 2 is carried by other means such as an external connector or the like. The details of these alternatives is neither shown, nor further discussed in this text, since these variations are clear and obvious for the skilled person. When using a BGA, only one row is needed, and thus it is conceivable to have a BGA where only those balls marked with section lines are present.

The first aperture 7 and the second aperture 9 are electromagnetically connected to the first cavity 13, and the second aperture 9 is electromagnetically connected to a second cavity 14 comprised in the waveguide resonator part 10.

The waveguide resonator part 10 is in turn electromagnetically connected to a waveguide section 15 (FIGS. 1, 2, and 4) via a third aperture 16 (FIGS. 1 and 4) comprised in the waveguide resonator part 10, such that a transition of microwave signals from the strip conductor 4 to the waveguide section 15 is obtained. The waveguide resonator part 10 and the waveguide section 15 are according to some aspects at least partly integrally formed, constituting a waveguide arrangement 26 (FIGS. 1, 2 and 4). The third aperture is here in the form of a waveguide iris and is delimited by a first wall part 27 (FIGS. 1, 2, and 4) and a second wall part 28 (FIGS. 1 and 4). Only a part of the waveguide section 15 is shown, the waveguide section 15 continuing to other parts such as for example antennas.

The first cavity 13 is sufficiently accurately defined since surface mounted technology (SMT) gives good alignment during the soldering process of the BGA 20, which results in an accurate positioning. As shown in FIG. 2, the direction is the same for the electromagnetic field $E_1$ in the first cavity 13, the direction of the electromagnetic field $E_2$ in the second cavity 14 and the direction of the electromagnetic field $E_3$ in the waveguide section 15. There is thus no need to bend the electromagnetic wave since the electromagnetic field $E_1$, $E_2$, $E_3$ has the same direction in both cavities 13, 14 and in the waveguide section 15.

The dimension of the cavities is according to some aspects designed to resonate close to the operating frequency of interest; such that all couplings and resonant frequencies are tuned similar to a two pole bandpass filter to get desired filter characteristic. In this case, broad banded filter characteristic are desired, such that a high degree of coupling is obtained from the strip conductor 4 to the waveguide section 15 via the cavities 13, 14. In particular, using two resonant cavities 13, 14 in this manner gives a strong coupling between them, which results in that most of the power is radiating from the strip conductor 4 to the waveguide section 15. The power radiating from the strip conductor 4 that is not coupled via the first aperture 7 will be practically negligible, and therefore there is no need for any cover that is mounted over the strip conductor 4.

Figure 5:
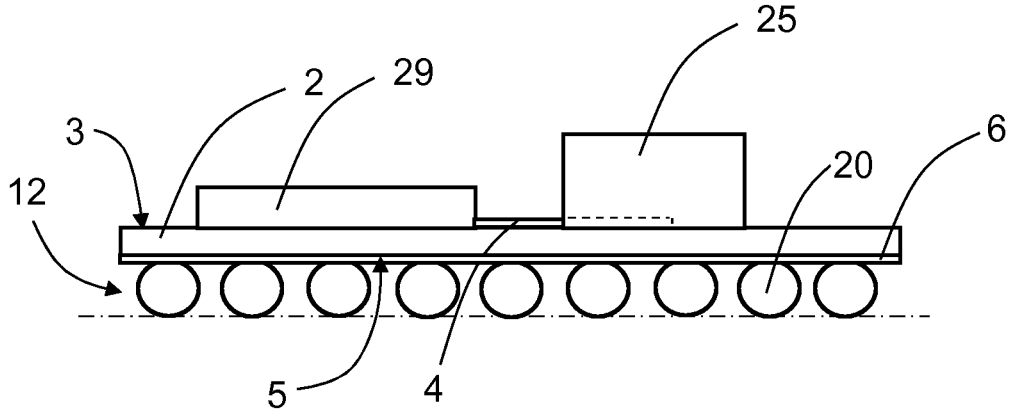
FIG. 5 shows a side view of the first dielectric layer with a housing.

However, with reference to FIG. 5 that shows a side view of the first dielectric layer 2 which has a first layer first side 3 and a first layer second side 5 on which a first ground plane 6 is positioned. The first dielectric layer 2 is attached and connected to a second dielectric layer 17 (FIGS. 1 and 2) by means of a ball grid array 20 (BGA), such that a wall structure 12 is formed by the BGA 20. For sensitive applications where it is desired that no radiation leaks from the waveguide transition arrangement 1 (FIG. 2), according to some aspects the waveguide transition arrangement 1 (FIG. 2) comprises an electrically conducting lid part 25 that is arranged to be mounted to the first layer first side 3 and to at least partially cover the first aperture 7 (FIGS. 2 and 3) and the strip conductor 4, where the strip conductor 4 is in this example extending from a chip part 29 that is mounted to the first layer first side 3.

Figure 6:
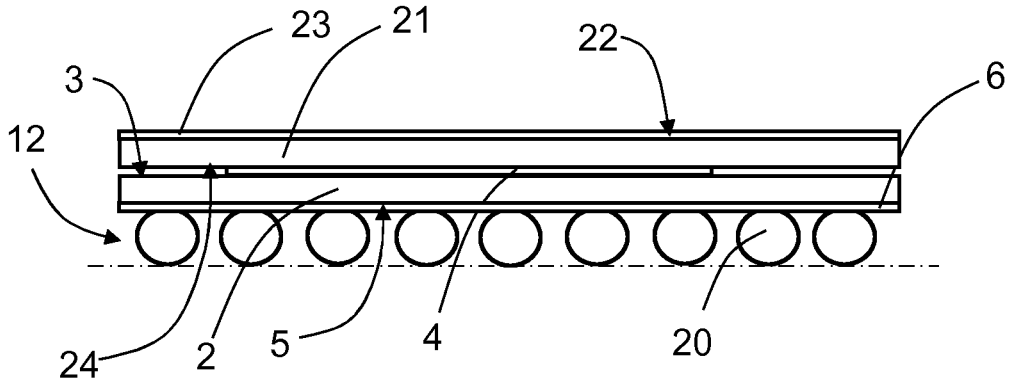
FIG. 6 shows a side view of the first dielectric layer and a third dielectric layer arranged in a stripline configuration.

Alternatively, with reference to FIG. 6 that shows a side view corresponding to the one in FIG. 5, the waveguide transition arrangement 1 (FIG. 2) comprises a first dielectric layer 2 and a third dielectric layer 21, where the first dielectric layer 2 has a first layer first side 3 and a first layer second side 5, where the first dielectric layer 2 is attached and connected to a second dielectric layer 17 (FIGS. 1 and 2) by means of a ball grid array 20 (BGA), such that a wall structure 12 is formed by the BGA 20. The third dielectric layer 21 has a third layer first side 22 on which a ground plane 23 is positioned and a third layer second side 24 that is arranged to face the strip conductor 4 such that a stripline arrangement is formed. In this manner, leakage is minimized or eliminated.

According to some aspects, there is no BGA at all, instead a wall structure constituted by a metal frame or the like is soldered to the first ground plane 6 and connected to the second ground plane 8 (FIGS. 2 and 4); either directly or indirectly by means of for example, vias.

According to some aspects, one or more dielectric layers is not used; it is, however, necessary that the first ground plane 6 and the second ground plane 8 are positioned in relation to each other as described with a wall structure formed between them such that the two cavities 13, 14 are formed as shown in FIG. 2.

Figure 7:
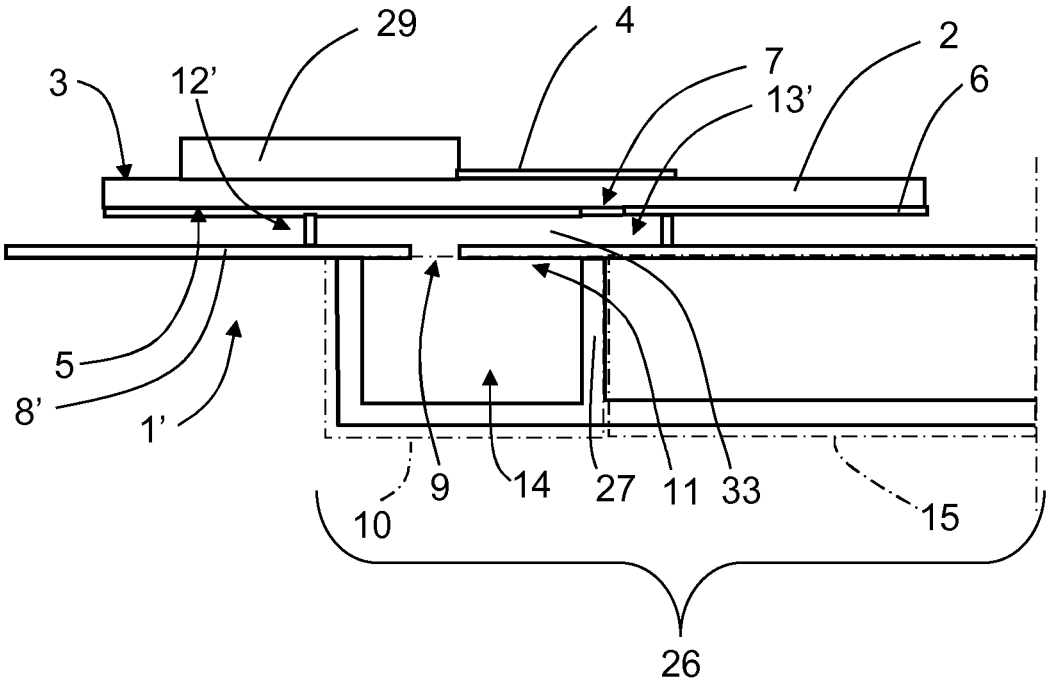
FIG. 7 shows a schematical cut-open side view of the a waveguide transition arrangement along a line A-A in FIG. 1, illustrating how an alternative first cavity is formed.
Figure 8:
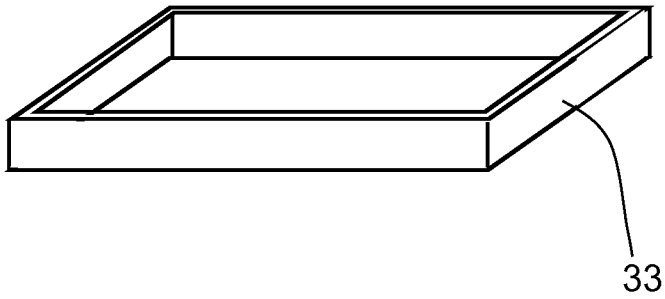
FIG. 8 shows a schematical perspective view of a metal frame.

According to some aspects, with reference to FIG. 7 (corresponding to FIG. 2) and FIG. 8, there is a waveguide transition arrangement 1' where a first cavity 13' (FIG. 7) is formed in an alternative way. The waveguide transition arrangement 1' with reference to FIG. 7 comprises a first dielectric layer 2 having a first layer first side 3 on which a strip conductor 4 is positioned and a first layer second side 5 on which a first ground plane 6 with a first aperture 7 is positioned, where the strip conductor 4 is in this example extending from a chip part 29 that is mounted to the first layer first side 3. A metal frame 33 as described above forms a wall arrangement 12' (FIG. 7) and is soldered directly to the first ground plane 6 (FIG. 7) and the second ground plane 8' (FIG. 7), the second dielectric layer 17 not being present. The second ground plane 8' is here a sheet of metal with a second aperture 9. Instead of the metal frame, some type of grid or meshed structure may be used to form the wall arrangement 12'. The waveguide transition arrangement 1' with reference to FIG. 7 further comprises a waveguide resonator part 10 that has an opening 11 that faces the second aperture 9. The first aperture 7 and the second aperture 9 are electromagnetically connected to the first cavity 13', and the second aperture 9 is electromagnetically connected to a second cavity 14 comprised in the waveguide resonator part 10. The waveguide resonator part 10 is in turn electromagnetically connected to a waveguide section 15 via a third aperture 16 (FIGS. 1 and 4) comprised in the waveguide resonator part 10, such that a transition of microwave signals from the strip conductor 4 to the waveguide section 15 is obtained. The waveguide resonator part 10 and the waveguide section 15 are, according to some aspects, at least partly integrally formed, constituting a waveguide arrangement 26. The third aperture 16 is here in the form of a waveguide iris and is delimited by a first wall part 27 and a second wall part 28.

According to some aspects, the strip conductor is generally constituted by a feed probe 4 (FIG. 7 that may have many forms. For example, it may be constituted by a metal rod that is suspended a certain distance from the first aperture 7 (FIG. 7), with or without the presence of a first dielectric layer 2 (FIG. 7). Such a metal rod or other suitable feed probe is of course applicable for all examples provided.

Figure 9:
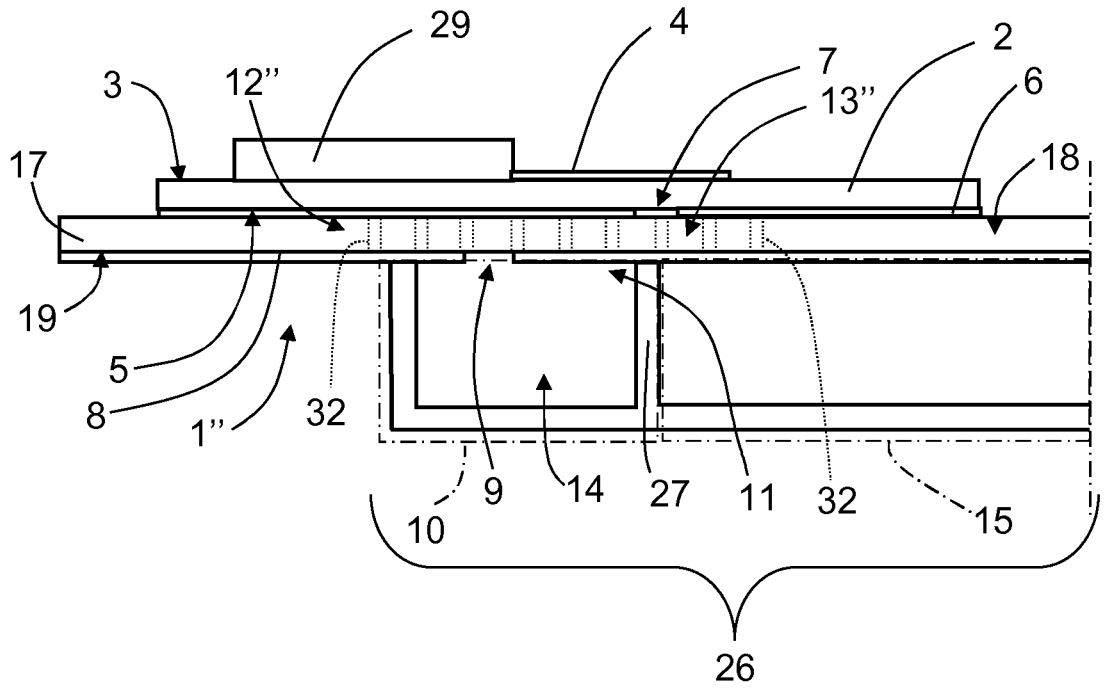
FIG. 9 shows a schematical cut-open side view of the a waveguide transition arrangement along a line A-A in FIG. 1, illustrating how an alternative first cavity is formed.
Figure 10:
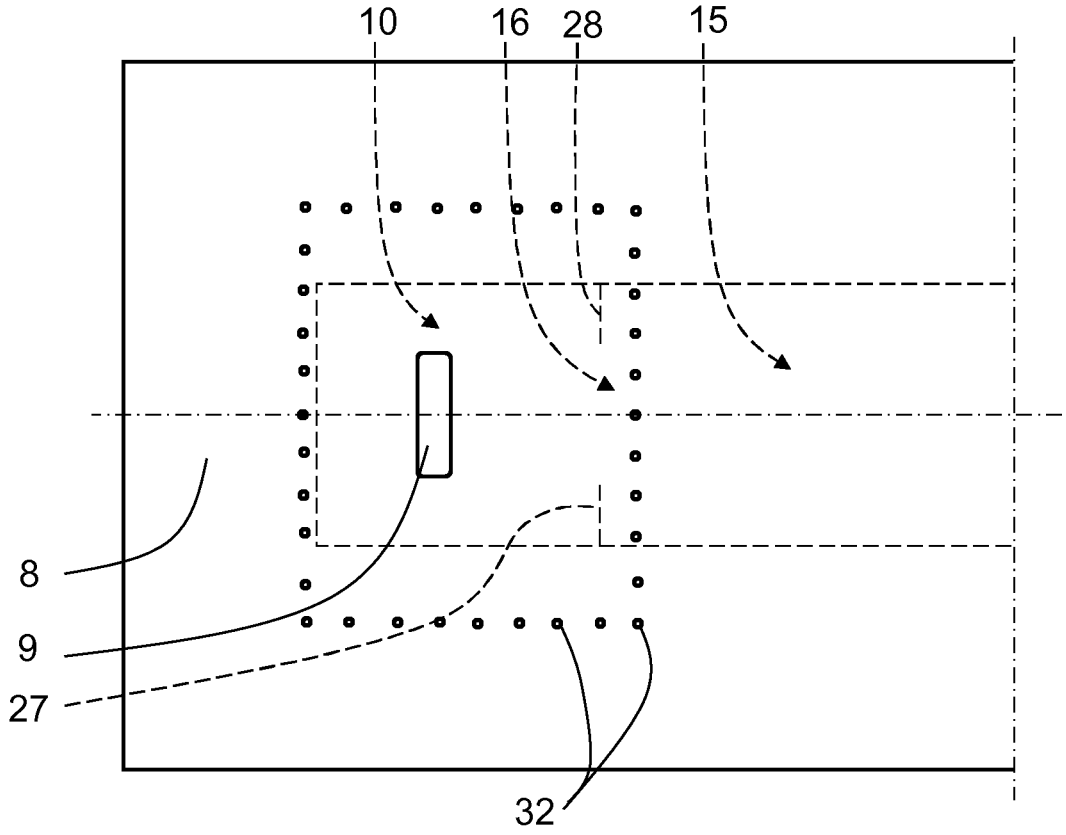
FIG. 10 shows a schematical bottom view of the second dielectric layer, illustrating how the alternative first cavity is formed.

According to some aspects, with reference to FIG. 9 and FIG. 10, corresponding to FIG. 2 and FIG. 4, there is a waveguide transition arrangement 1" (FIG. 9) where a first cavity 13" (FIG. 9) is formed in an alternative way. The waveguide transition arrangement 1" comprises a first dielectric layer 2 (FIG. 9) having a first layer first side 3 (FIG. 9) on which a strip conductor 4 (FIG. 9) is positioned and a first layer second side 5 (FIG. 9) on which a first ground plane 6 (FIG. 9) with a first aperture 7 (FIG. 9) is positioned, where the strip conductor 4 is in this example extending from a chip part 29 (FIG. 9) that is mounted to the first layer first side 3. The waveguide transition arrangement 1" further comprises a second dielectric layer 17 (FIG. 9) having a second layer first side 18 (FIG. 9) and a second layer second side 19 (FIG. 9) on which a second ground plane 8 (FIG. 9) with a second aperture 9 (FIGS. 9 and 10) is positioned. Here, the first ground plane 6 (FIGS. 9 and 10) is mounted against the second layer first side 18, and vias 32 (FIG. 9) connect the first ground plane 6 and the second ground plane 8. The vias 32 thus constitute the wall structure 12" (FIG. 9). The waveguide transition arrangement 1" further comprises a waveguide resonator part 10 (FIGS. 9 and 10) that has an opening 11 (FIG. 9) that faces the second aperture 9. The first aperture 7 and the second aperture 9 are electromagnetically connected to the first cavity 13", and the second aperture 9 is electromagnetically connected to a second cavity 14 (FIG. 9) comprised in the waveguide resonator part 10. The waveguide resonator part 10 is in turn electromagnetically connected to a waveguide section 15 (FIGS. 9 and 10) via a third aperture 16 (FIG. 10) comprised in the waveguide resonator part 10, such that a transition of microwave signals from the strip conductor 4 to the waveguide section 15 is obtained. The third aperture 16 is here in the form of a waveguide iris and is delimited by a first wall part 27 (FIGS. 9 and 10) and a second wall part 28 (FIG. 10).

According to some aspects, the waveguide transition arrangement is formed in silicon where appropriate parts of a piece of silicon material are removed and wall parts metalized where applicable, such that two cavities that connect a feed probe to a waveguide section via apertures as described in the examples above are formed.

The waveguide resonator part 10 and the waveguide section 15 are according to some aspects at least partly integrally formed, constituting a waveguide arrangement 26 (FIG. 9). The mounting position of the waveguide arrangement 26 to the second ground plane 8 is indicated with dashed lines in FIG. 4. According to some aspects, the waveguide arrangement 26 is surface-mounted to the second ground plane 8, the second ground plane 8 then at least partly forming one wall in the waveguide arrangement 26. Alternatively, the waveguide arrangement 26 can be formed as a metallization on a dielectric material such as silicon as discussed above. According to another aspect, the waveguide arrangement 26 is formed by removing material from a piece of metal that then is adhered to the second ground plane 8.

According to some aspects, the first layer 2 is mounted to the second layer 17 or the second ground plane 8 by means of surface mount technology (SMT) assembly.

The present disclosure is not limited to the example described above, but may vary freely within the scope of the appended claims. For example, the apertures 7, 9 may have any suitable shape; however the first aperture 7 has a second longitudinal extension L2 that is perpendicular to the first longitudinal extension L1 as shown in FIG. 3.

In this context, to be electromagnetically connected should in this context be interpreted to disclose that an electric radio frequency signal connection is obtained or at least obtainable.

Terms such as perpendicular should not be interpreted as mathematically exact, but within what is practically obtainable in the present context.

The dielectric layers 2, 17, 21 may be formed in any suitable material such as ceramics, a PTFE (Polytetrafluoroethylene) based plastic material or a foam material. The dielectric layers 2, 17, 21 may be formed in mutually different materials and/or in multi-layer structures with different materials.

The ground planes are either formed from metal cladding on the dielectric layers 2, 17, or as separate metal sheets.

The term BGA includes connectors/solderings which are not ball-shaped, such as for example square connectors/solderings.

According to some aspects, the second ground plane 8 with the second aperture 9 is positioned on the second layer first side 18. The second layer second side 19 may then comprise a further ground plane with a further aperture that ensures an electromagnetic connection to and from the second cavity 14 via the second aperture.

When a solder connections is mentioned, other types of electrical connections such as gluing using an electrically conducting adhesive are of course conceivable.

The present disclosure relates to a waveguide transition arrangement 1 comprising a first ground plane 6 with a first aperture 7, a feed probe 4 that crosses the first aperture 7, a second ground plane 8 with a second aperture 9, and a waveguide resonator part 10 that has an opening 11 that faces the second aperture 9, where the first ground plane 6 faces the second ground plane 8 and is positioned between the feed probe 4 and the second ground plane 8, and where the second ground plane 8 faces the waveguide resonator part 10. A wall structure 12 is at least partly arranged between the first ground plane 6 and the second ground plane 8 such that a first cavity 13 is formed in an enclosed volume between them, where the first aperture 7 and the second aperture 9 are electromagnetically connected to the first cavity 13, and where the second aperture 9 is electromagnetically connected to a second cavity 14 comprised in the waveguide resonator part 10, where the waveguide resonator part 10 in turn is electromagnetically connected to a waveguide section 15 via a third aperture 16 comprised in the waveguide resonator part 10, such that a transition for microwave signals from the feed probe 4 to the waveguide section 15 is obtained.

According to an example, the waveguide transition arrangement 1 comprises a first dielectric layer 2 having a first layer first side 3 and a first layer second side 5 on which first layer second side 5 the first ground plane 6 with the first aperture 7 at least partly is positioned.

According to an example, the waveguide transition arrangement 1 comprises a second dielectric layer 17 having a second layer first side 18 and a second layer second side 19, where the second ground plane 8 with the second aperture 9 is positioned on at least one of the second layer first side 18 and a second layer second side 19.

According to an example, a ball grid array 20 (BGA) that at least partly forms the wall structure 12, is attached to the first layer second side 5.

According to an example, the first ground plane 6 is mounted against the second layer first side 18, where vias 32 electrically connect the first ground plane 6 and the second ground plane 8, the vias 32 at least partly constituting the wall structure 12".

According to an example, a metal frame 33 forms a wall arrangement 12' and is electrically connected to the first ground plane 6 and the second ground plane.

According to an example, the feed probe 4 is constituted by a strip conductor 4 that is positioned on the first layer first side 3.

According to an example, the waveguide transition arrangement 1 comprises a third dielectric layer 21 having a third layer first side 22 on which a ground plane 23 is positioned and a third layer second side 24 that is arranged to face the strip conductor 4 such that a stripline arrangement is formed.

According to an example, the strip conductor 4 is constituted by a microstrip conductor comprised in a microstrip arrangement.

According to an example, the waveguide transition arrangement 1 comprises an electrically conducting lid part 25 that is arranged to be mounted to the first layer first side 3 and to at least partially cover the first aperture 7 and the strip conductor 4.

According to an example, the waveguide resonator part 10 and the waveguide section 15 are at least partly integrally formed; constituting a waveguide arrangement 26.

According to an example, the waveguide arrangement 26 is surface-mounted to the second ground plane 8, the second ground plane 8 then at least partly forming one wall in the waveguide arrangement 26.

According to an example, the first layer 2 is mounted to the second layer 17 or the second ground plane 8 by means of surface mount technology (SMT) assembly.

The invention claimed is:

1. A waveguide transition arrangement, comprising:

a first ground plane with a first aperture;

a feed probe that crosses the first aperture;

a second ground plane with a second aperture, wherein the first ground plane faces the second ground plane and is positioned between the feed probe and the second ground plane;

a waveguide resonator part that has an opening that faces the second aperture wherein the second ground plane faces the waveguide resonator part; and a wall structure arranged at least partly between the first ground plane and the second ground plane such that a first cavity is formed in an enclosed volume therebetween, wherein the wall structure is partly formed by a ball grid array, wherein the first aperture and the second aperture are electromagnetically connected to the first cavity, wherein the second aperture is electromagnetically connected to a second cavity disposed within the waveguide resonator part, and wherein the waveguide resonator part in turn is electromagnetically connected to a waveguide section via a third aperture disposed within the waveguide resonator part, such that a transition for microwave signals from the feed probe to the waveguide section is obtained.

2. The waveguide transition arrangement of claim 1:

further comprising a first dielectric layer having a first layer first side and a first layer second side, wherein the first ground plane with the first aperture is at least partly positioned on the first layer second side.

3. The waveguide transition arrangement of claim 2, wherein the ball grid array is attached to the first layer second side.

4. The waveguide transition arrangement of claim 2, wherein the feed probe is constituted by a strip conductor that is positioned on the first layer first side.

5. The waveguide transition arrangement of claim 4, further comprising a third dielectric layer having a third layer first side on which a ground plane is positioned and a third layer second side that is arranged to face the strip conductor such that a stripline arrangement is formed.

6. The waveguide transition arrangement of claim 4, wherein the strip conductor is constituted by a microstrip conductor comprised in a microstrip arrangement.

7. The waveguide transition arrangement of claim 6, further comprising an electrically conducting lid part that is arranged to be mounted to the first layer first side and to at least partially cover the first aperture and the strip conductor.

8. The waveguide transition arrangement of claim 2:

further comprising a second dielectric layer having a second layer first side and a second layer second side, wherein the second ground plane with the second aperture is positioned on at least one of the second layer first side and the second layer second side, and wherein the first dielectric layer is mounted to the second dielectric layer or the second ground plane by a surface mount technology assembly.

9. The waveguide transition arrangement of claim 1:

further comprising a second dielectric layer having a second layer first side and a second layer second side, wherein the second ground plane with the second aperture is positioned on at least one of the second layer first side and the second layer second side.

10. The waveguide transition arrangement of claim 1, wherein the waveguide resonator part and the waveguide section are at least partly integrally formed, constituting a waveguide arrangement.

11. The waveguide transition arrangement of claim 10, wherein the waveguide arrangement is surface-mounted to the second ground plane, the second ground plane then at least partly forming one wall in the waveguide arrangement.

* * * * *